US005598666A

United States Patent [19]

Kurth

[11] Patent Number: 5,598,666

[45] Date of Patent: Feb. 4, 1997

[54] ANTI-DERAILING MECHANISM FOR TRACK MOUNTED BATH DOORS

[75] Inventor: Michael J. Kurth, Howards Grove, Wis.

[73] Assignee: Kohler Co., Kohler, Wis.

[21] Appl. No.: 582,859

[22] Filed: Jan. 4, 1996

[51] Int. Cl.[6] ..... E05D 15/06

[52] U.S. Cl. ..... 49/409; 4/557

[58] Field of Search ..... 49/409, 410, 411; 4/557

[56] References Cited

U.S. PATENT DOCUMENTS

| | | | |
|---|---|---|---|
| 2,786,227 | 3/1957 | Pearson | 16/105 |
| 2,929,115 | 3/1960 | Beckstrom | 49/411 |
| 3,425,162 | 2/1969 | Halpern | 49/409 X |
| 3,615,144 | 10/1971 | Plemeng | 49/411 |
| 4,881,768 | 11/1989 | Lange | 292/251 |
| 4,987,638 | 1/1991 | Ribaudo | 16/89 |
| 5,079,872 | 1/1992 | Short | 49/409 |
| 5,115,596 | 5/1992 | Fevold et al. | 49/411 |
| 5,123,128 | 6/1992 | Hines | 4/557 |
| 5,148,630 | 9/1992 | Llorens | 49/425 |

FOREIGN PATENT DOCUMENTS

| | | | |
|---|---|---|---|
| 291114A | 6/1991 | Germany | 49/409 |

*Primary Examiner*—Philip C. Kannan
*Attorney, Agent, or Firm*—Quarles & Brady

[57] ABSTRACT

A door system for a bathing enclosure which includes a track extending above an opening of the enclosure with the track having a rail with an upper surface having a longitudinal groove. A door has first and second rollers which ride in the rail groove, so that the door is suspended from and slidable along the track. A separate stop is associated with each roller with each stop having a first locking bracket fixed to the door and a member is movably attached to the locking bracket. The members are adjustable between a first position at which the first roller may be removed from the groove and a second position at which the first member strikes the track before the first roller can be removed from the groove.

5 Claims, 1 Drawing Sheet

ANTI-DERAILING MECHANISM FOR TRACK MOUNTED BATH DOORS

BACKGROUND OF THE INVENTION

The present invention relates to sliding doors of the type commonly used as part of a shower or tub enclosure; and more particularly to such doors that are suspended from and slidable along an overhead track.

Tub and shower enclosures often have an opening that is closed with a pair of sliding doors. A common door assembly has a lower track mounted on the rim of the tub or shower pan and another track mounted directly overhead. Each door slides in separate channels within the tracks and is able to slide past the other door.

In one version of this type of door assembly, a pair of rollers are mounted on the door and ride in a groove in the overhead track. The rollers enable the door to glide easily in a horizontal direction along the overhead track. However, a bather could inadvertently raise the door in a manner that causes the rollers to dislodge from the rail and allows the door to fall into or out of the tub.

In addition, the design allows the user to tip the door inward to clean the door and the lower track. It also is desirable to prevent the door from coming off the overhead track while the door is tipped for cleaning.

SUMMARY OF THE INVENTION

The general object of the present invention is to provide a door assembly for a tub or shower enclosure in which a door is suspended from an overhead track in a manner that allows the door to slide along the track.

Another object is to provide such a sliding door assembly with a mechanism that restricts upward movement of door thereby preventing the door from derailing from the overhead track.

These objects are fulfilled by a door system for a bathing enclosure which includes a track with a rail extending above an opening of the bathing enclosure. A door panel has at least one roller attached thereto and engaging the rail, so that the door is suspended from and slidable along the track. A stop is attached to the door in a manner that allows the stop to be moved vertically with respect to the door. In one position of the stop, the door may be removed from the track and in another position the stop strikes the track before the door is able to disengage the track.

In the preferred embodiment, the stop comprises a locking bracket fixed to the door and having a threaded aperture which extends vertically through the locking bracket. A threaded rod inserted into the aperture. By turning the rod within the aperture, the spacing between the rod and the track can be adjusted to either provide clearance for the door to be removed from the track or prevent such removal by not providing a sufficient amount of clearance.

DETAILED DESCRIPTION OF THE INVENTION

Figure 1:
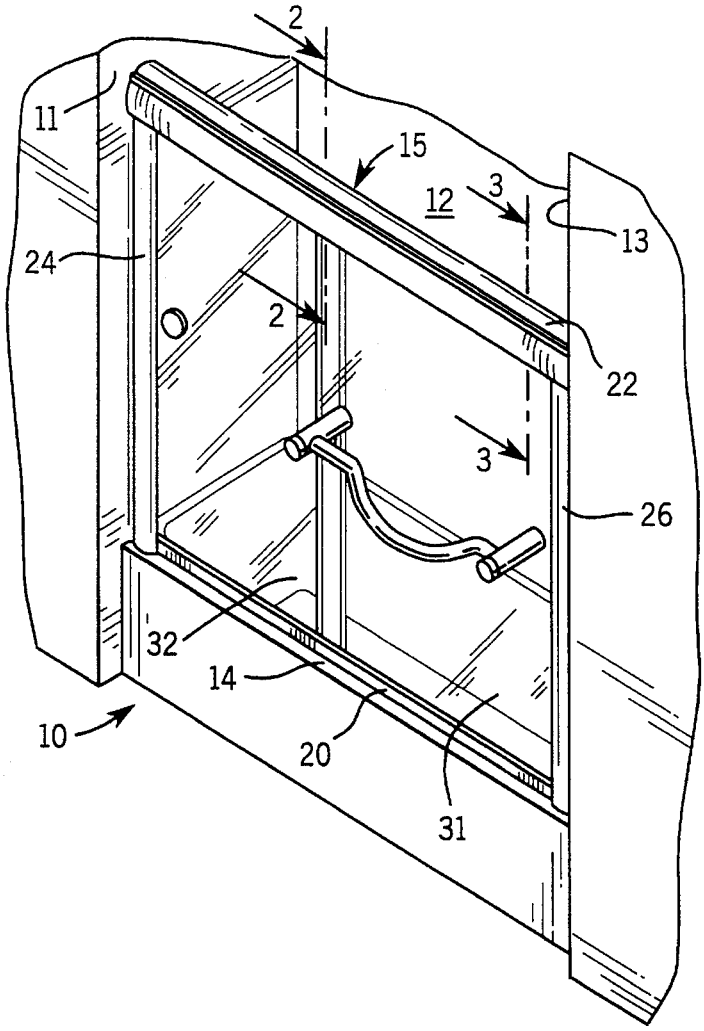
FIG. 1 is a pictorial representation of a shower enclosure with a sliding door system which incorporates the present invention.

With initial reference to FIG. 1, a bath tub 10 is located in a recess formed by walls 11, 12 and 13. Although the present door system is being described in the context of a bath tub, it also can be applied to showers and other bathing enclosures. The bath tub 10 includes a front rim 14 extending between walls 11 and 13.

The tub recess is closed by a door system 15 includes a lower track 20 mounted on the front tub rim 14 and an overhead track 22 which extends directly over the lower track between walls 11 and 13. A separate wall jamb 24 or 26 is mounted vertically along each side wall 11 or 13, respectively, between the two tracks 20 and 22. The tracks 20 and 22 and wall jambs 24 and 26 define an opening of the tub enclosure. Two glass-panel doors 31 and 32 are suspended from the overhead track 22 in the enclosure opening and extend downward to the front rim 14 of the tub 10 into the lower track 20. The outer door 31 and the inner door 32 can slide in either direction past one another along the two tracks 20 and 22 to create a passageway adjacent either side wall 11 or 13 through which a bather enters and exits the shower enclosure 10.

Figure 2:
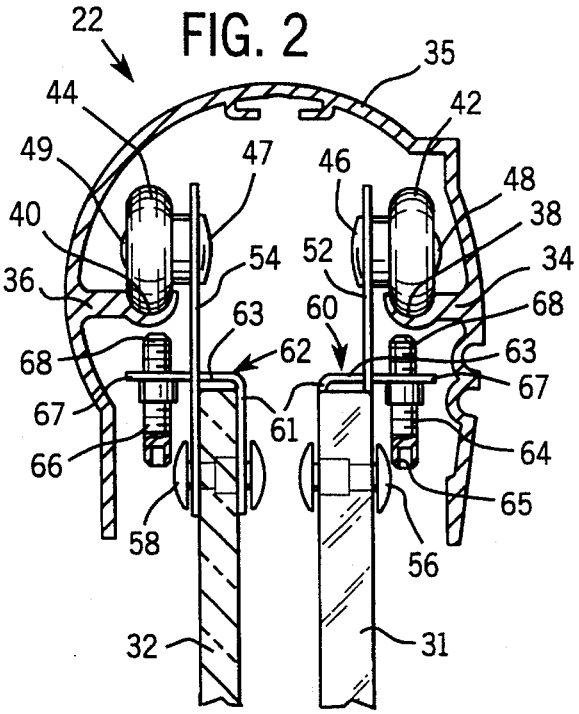
FIG. 2 is a cross-sectional view through the overhead track of the door system along line 2—2 in FIG. 1.

With reference to FIG. 2, the overhead track 22 is formed by an elongated channel member 35 with an inverted U-shaped cross section and having outer and inner horizontal rails 34 and 36 within the opening of the channel. Each rail 34 and 36 has a longitudinal groove 38 and 40, respectively, within which rollers 42 and 44 ride. Roller 42 is mounted on an axle 48 attached to a fastener 46 that extends through a hole near the top edge of a mounting bracket 52 fixed to the outer door 31. The other illustrated roller 44 is mounted on axle 49 that is connected by a fastener 47 that extends through a mounting bracket 54 attached to the inner door 32.

Two roller assemblies of this design are spaced apart along the top edge of each door 31–32. The rollers for the inner door 32 ride on the inner rail 36, while the outer door rollers engage the outer rail 34.

Door fasteners 56 and 58, which hold the mounting brackets 52 and 54, respectively, on the two doors 31 and 32, also attach locking brackets 60 and 62 to those doors, although the combination of a mounting bracket and a locking bracket could be fabricated as a single piece. Each locking bracket 60 and 62 is L-shaped with one end of a vertical leg 61 attached to the respective door 31 or 32. The horizontal leg 63 of each locking bracket extends over the top of the respective door, through a hole in the respective mounting bracket, and under the rail 34 or 36 on which the corresponding door rides. The end 67 of the horizontal 63 leg that is under the rail has a threaded aperture there through and a threaded rod 64 or 66 is received in the threaded aperture of the locking bracket 60 or 62, respectively. The lower end of each threaded rod 64 and 66 has a hexagonal aperture 65 for receiving an allen wrench in order to turn the rod in the locking bracket aperture.

Figure 3:
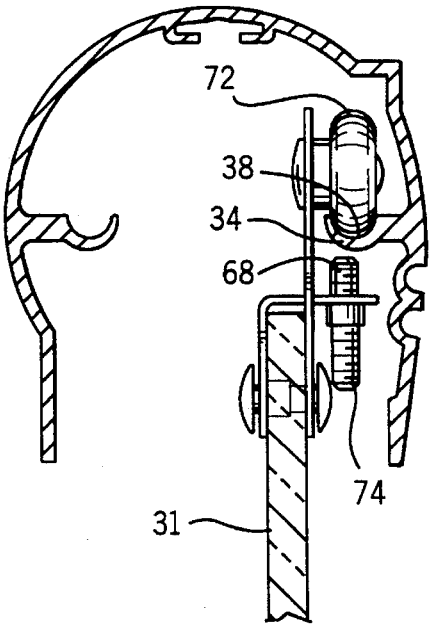
FIG. 3 is a cross-sectional view through the overhead track of the door system along line 3—3 in FIG. 1.

FIG. 3 shows the other roller 72 with its mounting bracket for the outer door 31. The inner door 32 has a similar second roller near wall jamb 24.

When the outer door 31, for example, is being assembled onto the overhead track 22, the threaded rods 64 and 74 are turned as far downward as possible, i.e. to a position that creates the largest gap between the rods and rollers 42 and 72. The outer door then is slid upward into the track 22 so that the rollers pass between the two rails 34 and 36 and then into the groove 38 in the outer rail 34. Once both rollers 42 and 72 are located in the groove 38, the installer inserts an allen wrench into the hexagonal aperture 65 of each threaded rod 64 and 74. Each threaded rod then is turned to raise it toward rail 34 and decrease the gap between the rod and that rail. The threaded rods are turned until each gap is less than the depth of the groove 38 in the track rail 34, while leaving a small spacing to permit the outer door 31 to slide along the track 22.

In this state, when the outer door 31 is raised upward, the top ends 68 of threaded rods 64 and 74 strike the underside of rail 34 before the rollers 42 and 72 are able to leave the rail groove 38. Thus threaded rods 64 and 74 act as stops preventing the outer door 31 from derailing from the track 22. The outer door can be removed from the track by lowering the threaded rods in the respective locking bracket apertures and reversing the steps of the assembly process. The inner door 32 functions in a like manner.

I claim:

1. A door system for a bathing enclosure which has an opening, said door system comprising:

a track extending above the opening and having a rail;

a door;

at least one roller attached to the door and engaging the rail, so that the door is suspended from and slidable along the track; and a stop attached to door and moveable vertically with respect to the door between a first position at which the door may be removed from the track and a second position at which the stop strikes the track preventing removal of the door, said stop comprising a locking bracket fixed to the door with a threaded aperture extending through the locking bracket; and a threaded rod inserted into the threaded aperture.

2. A door system for a bathing enclosure which has an opening, said door system comprising:

a track extending above the opening and having a rail with an upper surface that has a groove therein;

a door;

first and second rollers attached to the door and riding in the groove of the rail, so that the door is suspended from and slidable along the track; and a first stop having a first locking bracket fixed to the door with a first threaded aperture extending through the first locking bracket, and having a first threaded rod inserted into the first threaded aperture and moveable with respect to the first locking bracket between a first position at which the first roller may be removed from the groove and a second position at which the first threaded rod strikes the track before the first roller can be removed from the groove.

3. The door system as recited in claim 2 wherein the threaded rod strikes the rail in the second position before the first roller can become removed from the groove.

4. The door system as recited in claim 2 further comprising a second stop having a second locking bracket fixed to the door with a second threaded aperture extending through the second locking bracket; and having a second threaded rod inserted into the second threaded aperture and moveable with respect to the second locking bracket between one position at which the second roller may be removed from the groove and another position at which the second threaded rod strikes the track before the second roller can be removed from the groove.

5. A door system for a bathing enclosure which has an opening, said door system comprising:

a track extending above the opening and including a first rail and a second rail, each rail having an upper surface that has a groove therein;

first and second doors;

first and second rollers attached to the first door and riding in the groove of the first rail, so that the first door is suspended from and slidable along the track;

third and fourth rollers attached to the second door and riding in the groove of the second rail, so that the second door is suspended from and slidable along the track;

a first stop including a first locking bracket fixed to the first door with a first threaded aperture extending through the first locking bracket, and having a first threaded rod inserted into the first threaded aperture and moveable vertically with respect to the first locking bracket between one position at which the first roller may be removed from the groove in the first rail and another position at which the first threaded rod strikes the track before the first roller can be removed from the groove in the first rail; and a second stop including a second locking bracket fixed to the second door with a second threaded aperture extending through the second locking bracket, and having a second threaded rod inserted into the second threaded aperture and moveable vertically with respect to the second locking bracket between first position at which the third roller may be removed from the groove in the second rail and a second position at which the second threaded rod strikes the track before the third roller can be removed from the groove in the second rail.

* * * * *